United States Patent [19]

Borsani

[11] Patent Number: 4,966,341

[45] Date of Patent: Oct. 30, 1990

[54] MODULAR MULTILEVEL ARTICLE OF FURNITURE

[75] Inventor: Paolo Borsani, Milan, Italy

[73] Assignee: Tecno S.p.A. Mobili e Forniture per Arredamento, Milan, Italy

[21] Appl. No.: 506,544

[22] Filed: Apr. 4, 1990

Related U.S. Application Data

[60] Division of Ser. No. 390,433, Aug. 3, 1989, abandoned, which is a continuation of Ser. No. 97,484, Sep. 15, 1987, abandoned.

[30] Foreign Application Priority Data

Sep. 15, 1986 [IT] Italy ..... 23020/86[U]
Sep. 15, 1986 [IT] Italy ..... 23022/86[U]

[51] Int. Cl.[5] ..... F16M 11/00

[52] U.S. Cl. ..... 248/165; 248/188; 248/188.4; 248/188.5; 182/181; 182/222; 108/153

[58] Field of Search ..... 248/188, 188.1, 165, 248/188.7, 188.5; 182/181, 185, 179, 222, 224; 108/157, 153

[56] References Cited

U.S. PATENT DOCUMENTS

| | | | |
|---|---|---|---|
| 249,508 | 11/1881 | Douns | 182/185 |
| 362,915 | 5/1887 | Zeigler | 182/185 X |
| 2,238,294 | 4/1941 | Scott et al. | 248/673 X |
| 2,347,745 | 5/1944 | McKinney | 182/181 X |
| 2,408,247 | 9/1946 | Wekeman | 248/165 X |
| 2,505,990 | 5/1950 | Pollock | 248/165 X |
| 2,829,934 | 4/1958 | Schulze | 108/157 |
| 3,848,701 | 11/1974 | Hughes | 248/188 X |
| 4,256,300 | 3/1981 | Boucher | 248/165 X |
| 4,260,040 | 4/1981 | Kieffer | 182/224 X |
| 4,520,981 | 6/1985 | Harrigan | 248/188.7 X |
| 4,565,263 | 1/1986 | Southworth | 182/185 X |
| 4,748,913 | 6/1988 | Favaretto et al. | 108/153 X |

FOREIGN PATENT DOCUMENTS

| | | | |
|---|---|---|---|
| 176344 | 3/1953 | Austria | 182/224 |
| 36066 | 7/1966 | Finland | 182/185 |
| 1513248 | 1/1968 | France | 108/153 |

*Primary Examiner*—Alvin C. Chin-Shue
*Attorney, Agent, or Firm*—Herbert Dubno

[57] ABSTRACT

A support structure for office tables and desks is constituted of a cylindrical connecting element having a substantially horizontal axis, equipped with a plurality of lateral connectors, to some of which there are connected two or more pairs of inclined legs, diverging downwards at least in a vertical plane perpendicular to the axis of the connecting element. A plurality of support elements are connected to said legs and/or said tubular body for one or more working planes, projecting horizontally and transversely and/or oblique with respect to the axis of the connecting element. At the upper ends of the legs connector members can be provided to which there may be attached pairs of uprights carrying an upper plane and/or other members raised above the working plane.

5 Claims, 7 Drawing Sheets

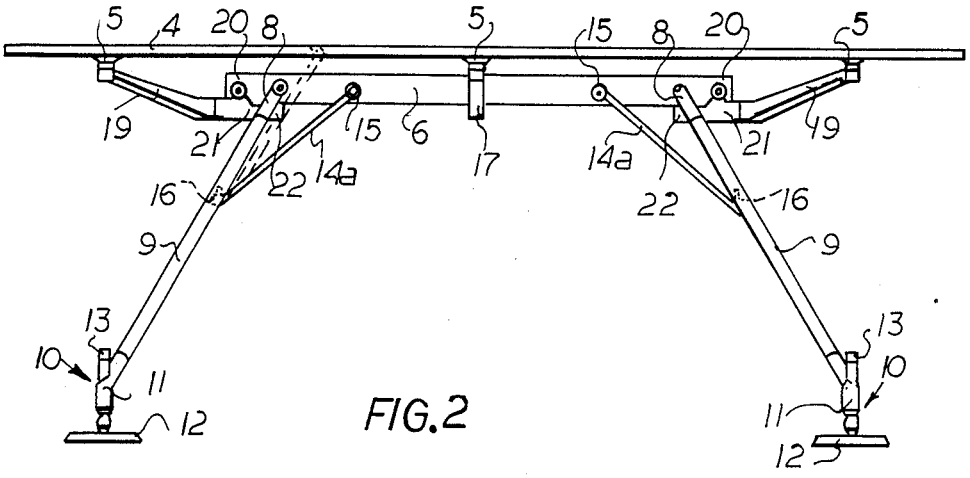
FIG.2
FIG.3
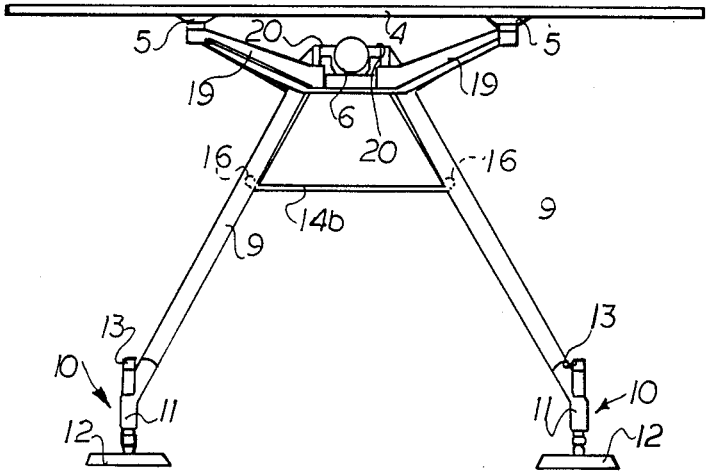

FIG.8
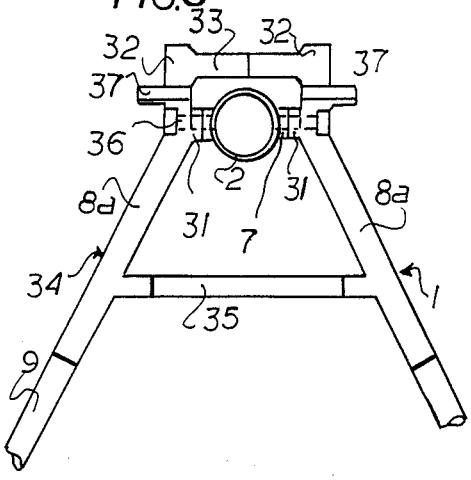
FIG.9
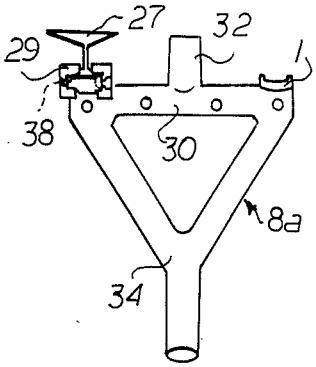
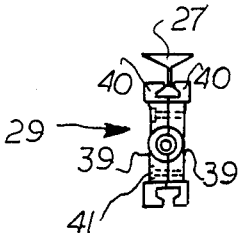
FIG.10
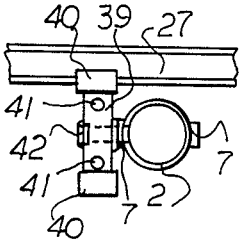
FIG.11

MODULAR MULTILEVEL ARTICLE OF FURNITURE

This is a divisional of co-pending application Ser. No. 390,433 filed on Aug. 3, 1989 now abandoned, which is a continuation of Ser. No. 097,484 filed Sept. 15, 1987, now abandoned.

FIELD OF THE INVENTION

My present invention relates to a support structure for office furniture.

BACKGROUND OF THE INVENTION

In working furniture, especially for offices and the like, there is a need for supporting structures adapted for the construction of tables, desks, etc., which may be rapidly assembled, offering high rigidity, and which may also enable several supporting and working planes to be provided according to requirements, either as isolated items of furniture or as contiguous structures connected together to form multiple working units, adapted for the use of several persons.

In particular, there is a need for an item of furniture, the supporting structure of which enables several carrying or support planes to be provided both below the working plane and above it, for arranging, for instance, documents and volumes, calculating equipment, visual display screens, telephonic apparatus and so on, in a single unitary structure of high rigidity.

For the production of tables for a wide variety of purposes, especially office tables and the like, it is desirable to provide a structure which will enable tables of various dimensions to be constructed, whether rectangular, square or circular, high or low, while keeping the greatest possible number of components unchanged, with a firm construction which lends itself to assembly or erection in a simple manner, and which also makes it possible itself to vary the height of the table itself from the floor.

SUMMARY OF THE INVENTION

These requirements are satisfied by the present invention, which provides a modular support structure for office tables and desks which is constituted of a cylindrical connecting element having a substantially horizontal axis, equipped with a plurality of lateral connectors, to some of which there are attached two or more pairs of inclined legs. The legs diverge downwardly at least in a vertical plane perpendicular to the axis of the connecting element, there being connected to said legs and/or said tubular body a plurality of supporting elements for one or more working planes, projecting horizontally and transversely and/or inclined with respect to the axis of the connecting element. At the upper ends of the legs there may be present connector members to which there may be connected pairs of uprights carrying an upper plane and/or other members raised above the working plane.

According to one embodiment, the legs are composed of a rectilinear cylindrical element, equipped in its upper part with a portion of substantially triangular shape with the apex downwards, connected to the rectilinear cylindrical element, the base side of the triangular shaped portion being capable of being connected by screw connectors to the cylindrical connecting element. There is also provided, close to the apex of the triangular shaped portion, a connector for a transverse member, by which two mutually facing triangular portions, connected at the top to the same tubular member, are connected to each other in a position diverging downwards in a plane transverse to the axis of the connecting element. At the lower ends of the legs, support feet can be provided for bearing upon the floor, the support feet being adjustable in height.

In a median position on the base side of the triangular portion of each leg, there is an upwardly facing stub pipe, equipped with connectors for vertical columns.

At the ends of the base side of the triangular portion of each leg, there are slides adapted for accomodating transverse members for supporting a working plane, in cooperation with clamps which can be clamped on the slides themselves for blocking the transverse members in position.

Preferably, in this embodiment, the cylindrical connecting element is equipped with four pairs of threaded connectors, at opposite ends, adapted for the connection by screws or similar attachment means to corresponding connectors of the base of the triangular portion of the legs, and with other pairs of intermediate threaded connectors, adapted for permitting the attachment of clamps for fixing the transverse support members for the working plane and/or of support elements beneath the plane itself.

In the support structure according to this invention, there may be present two pairs of uprights connected to the vertical stub pipes of two pairs of contiguous legs. To the upper ends of the uprights there are connected load-bearing cruciform pieces fitted to the ends of horizontal cylindrical support elements. The elements may have fitted thereto support planes, suspended shelves, lamps, office equipment, lamps or the like.

The vertical columns may also comprise lifting actuators adapted for the vertical translatory movement of the horizontal support elements and the elements fitted to them, between an access position for the elements themselves, close to the working plane, and an at-rest position, remote from the working plane.

In one alternative embodiment, the modular support structure for office tables and desks according to this invention is constituted of a connecting element equipped with a plurality of connectors, to which there are connected four legs, having inclined axes diverging downwards both in the vertical plane containing the axis of the connecting element and in planes perpendicular to this plane. A plurality of support arms for a working plane are equipped at the ends with support members for the plane itself, two pairs of which are constituted each of two arms connected together at the base and diverging at an angle, and are fitted to opposite ends of the connecting element. Support feet are provided for bearing on the floor, are adjustable in height, and are located at the lower ends of the legs.

In this embodiment, the connecting element is advantageously composed of a tubular member, of which at least the central portion possesses a horizontal axis, on the surface of which there are present pairs of threaded connectors, opposite each other in a horizontal diametral plane. To these connectors there may be fitted by means of screws the legs, stiffening ties and the support arms for the working plane, the length of the connecting element being chosen having regard to the dimensions desired for the working plane of the table.

The legs are constituted each of an upper bent cylindrical element, capable of being connected to one of the connectors of the connecting element, to which bent element there is fitted a rectilinear cylindrical element, connected in its turn at the end to a support foot for bearing on the floor. This latter element is a bent element having an end portion with a substantially vertical axis, inside which there is inserted a bolt carrying at its end a support member, which bolt may be inserted in two positions, corresponding to different degrees of downward projection.

The support member may be composed of an articulated disc, a fixed or pivotal roller, or similar means.

The support arms are constituted of pairs of mutually opposed arms, connected together at one end and equipped at the top with connectors capable of being coupled to the threaded connectors of the connecting element. The arms can also be provided at their ends with bearing and fixing members for the working plane.

The end support arms are connected together at an angle.

The connecting element, in the case of a table having a plane which is circular, square or of reduced length, is advantageously composed of a tubular member having a rectilinear median portion with 2 horizontal axis, equipped with a pair of threaded connectors disposed diametrically opposite one another along a horizontal diameter passing through the center line, and having oblique, downwardly orientated end portions with an axial inclination equal to that intended for a pair of legs. These end portions can be equipped with connector heads adapted for the attachment of the rectilinear cylindrical element of the legs.

In the case of a table having a plane which is circular, square or of reduced length, the arms are preferably arranged in a group of four, connected together at one end and angled one from another, in opposite pairs, equipped at the top with members for fixing to the threaded connectors of the tubular member, it being possible for two legs of a pair lying in a plane perpendicular to the pair of legs connected to the inclined portions of the tubular member to be connected to the connectors themselves externally to said connectors.

BRIEF DESCRIPTION OF THE DRAWING

FIG. 2 is a side view of the table of FIG. 1 in lateral view;

FIG. 3 is a front view of the table of FIG. 1;

FIG. 8 is a side view, drawn to a larger scale of a detail of the support legs for the table of FIG. 5

FIG. 9 is a front view detail of the support legs of FIG. 8;

FIG. 10 is a front view detail of the support members for the plane of the table of FIG. 5;

FIG. 11 is a side view of the detail of FIG. 10; and

SPECIFIC DESCRIPTION

Figure 1:
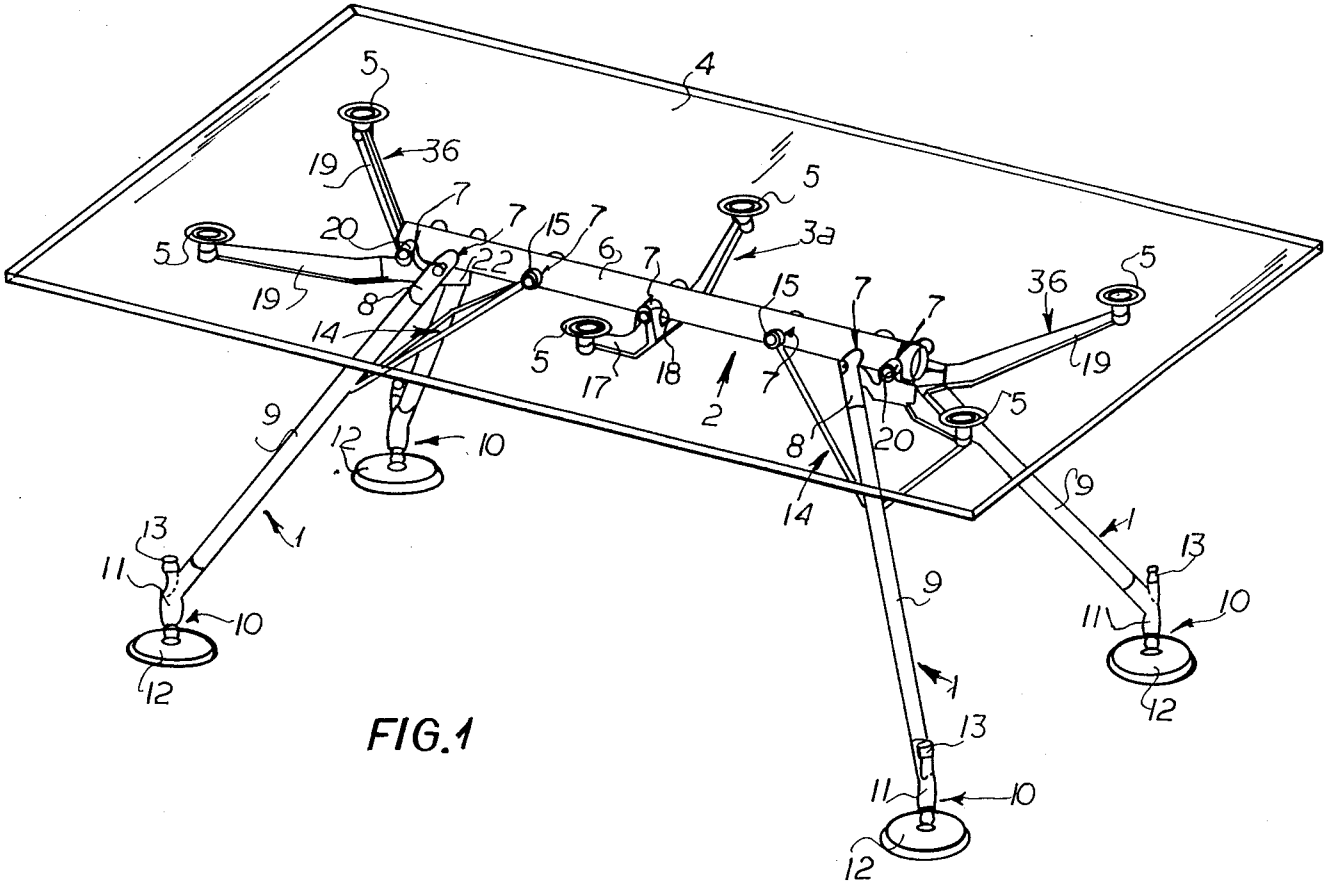
FIG. 1 is a perspective view of a table having a structure according to this invention in one in perspective view, embodiment, in perspective view, with the working plane transparent.

FIG. 1 shows, the structure according to this invention, in a first embodiment applicable to a rectangular table, is constituted of a support frame comprising four legs 1, connected at the top to a connecting element 2, to which there are in turn fixed a plurality of support arms 3 for the plane 4, the plane being fixed to them or simply resting upon suction cups 5, or having other fixing and support means.

In greater detail, the connecting element 2 is composed of a tubular body 6, preferably of metal, provided with a plurality of diametrically opposed pairs of threaded seats 7, arranged laterally, to which are connected the legs and support arms and support ties for the legs.

The choice of an appropriate dimension for the tubular body constituting the element 2 enables a wide variety of sizes of tables to be fabricated while keeping the other supporting elements unchanged.

Each leg is composed of an upper, angled element 8, fixed by a screw to one of the threaded seats 7 of the tubular body 6, and to this there is connected the rectilinear cylindrical element 9 and the support foot 10 for resting on the floor. The latter in turn comprises the angled cylindrical portion 11 and a base disc 12, connected to the angled portion 11.

The disc 12 is advantageously connected, by a ball joint and a screw, to a bolt 13, inserted into a corresponding vertical hole of the angled portion 11.

The bolt 13 possesses an annular raised shoulder at an asymmetrical position and the associated hole possesses an upper zone of reduced diameter, sufficient for accepting the bolt 13, and a lower zone of larger diameter, adapted for receiving the raised shoulder.

In this manner it is possible to secure the support disc 12 to one end of the bolt 13, thus obtaining a certain height from the floor, or the bolt 13 may be mounted in the inverted position, with the support disc 12 secured to its opposite end, thereby obtaining a different height from the floor, for example greater height.

The fine adjustment of the height of the support in order to obtain simultaneous bearing on the floor of all four of the base discs, even in the case where the surface on which the table rests is uneven, is obtained by screwing the connecting screw of the disc 12 by different distances into the bolt 13.

Instead of the discs 12, rollers or other support devices for resting on the floor may be attached to the bolts 13 of the legs, depending upon the technical and aesthetic requirements for the use of the table.

The legs 1 are held in the correct position and orientation, at the intended inclination, by means of inclined ties 14, appropriately constructed of metal rod shaped into an isosceles triangle, with the oblique sides **14*a* secured, at the ends converging towards the common apex, to the tubular member 6, and secured at the opposite ends, corresponding to the base side 14*b*, to a pair of legs of the table, as can be better seen from FIGS. 2 and 3**.

In greater detail, the ties 14 possess, at the ends of the inclined sides **14*a*, connectors 15 for securing to the threaded connectors 7 of the tubular member 6 by means of screws or the like; at the ends of the base side 14*b* there are present upwardly bent portions 16, adapted to be inserted into corresponding holes of the legs 1 before the connectors 15 are attached to the tubular body 6, thus orientating the tie as indicated in the broken line in FIG. 2. The subsequent rotation of the tie into the position for fixing to the relevant connectors 7, therefore, brings the ties into a transverse position with respect to the associated holes in the legs 1**, so that they can no longer be pulled out and the stiffness and firmness of the structure is assured, with an economical construction and a minimum number of assembly operations.

The support arms 3 are composed of intermediate arms 3*a* and end arms 3*b*; the intermediate arms 3*a* are constituted of a pair of opposed arms 17 connected together, supported beneath the member 6 by associated connectors 18, straddling the member 6 and connected by screws to the corresponding connectors 7 of the tubular member 6. The the end arms 3*b* are, in turn, constituted of a pair of arms 19 connected together at an angle, equipped with connectors 20 straddling the member 6 by which they are secured to the corresponding connectors 7 located at the ends of the tubular member 6. The continuation 21 of the arms 3*b*, equipped with the associated connector 22, prevents rotation of the arms under the effect of the load applied by the plane 4 and the objects disposed on it.

Figure 4:
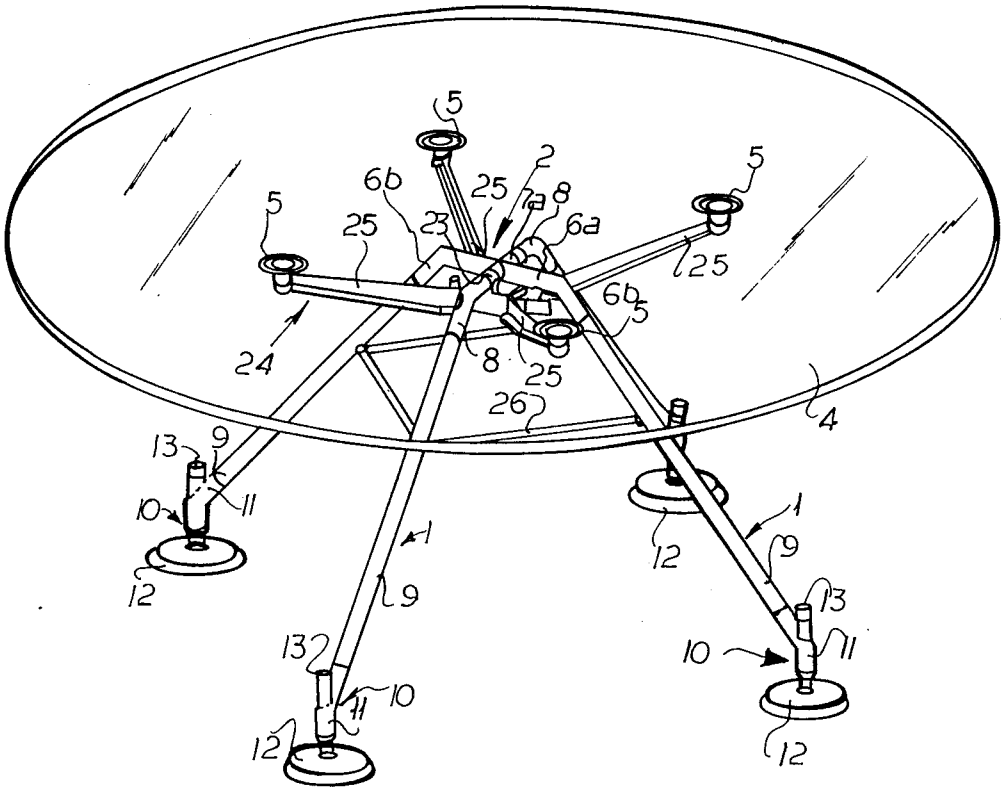
FIG. 4 is a perspective view of an alternative form of the table of FIG. 1, with a support frame for a circular plane.

For constructing a circular table, as illustrated in FIG. 4, or a square table or one of fairly restricted length, the connecting element 2 may advantageously be composed of a tubular member 6*a* which possesses a shaped form, comprising a short rectilinear central portion having a horizontal axis and end portions 6*b* inclined with oblique axes, along the direction of a pair of mutually opposed legs. To these portions 6*b* there are connected the rectilinear portions 9 of the legs, while the central portion of the tubular member 6*a* carries the threaded connectors 7*a*, to which the corresponding connectors 23 of the support arms 24 for the plane are secured; outside the connectors 23, which straddle the tubular member advantageously secured by the same through screw, the upper cranked or bent members 8 of the second pair of legs are secured.

At the ends of the legs 1 are the floor support feet 10, already described.

The arms 24 are constructed as a single element, comprising four arms 25, connected together at an angle one from another in opposed pairs, carrying at their ends the support elements 5 for the plane; the arms 24 have basically the shape of two opposed pairs of end arms 3*b*, having the connectors 20 in common.

The legs 1 are therefore connected together by a tie 26, appropriately of metal bar shaped in the form of a square or rhomboid, which ensures the rigidity of the assembled structure.

The supporting structure according to this invention is suitable therefore for the construction of tables of many dimensions, simply by replacing the element 2, which adapts to a multiplicity of shapes of working planes; its structure is, moreover, especially firm and rapid to erect.

Figure 5:
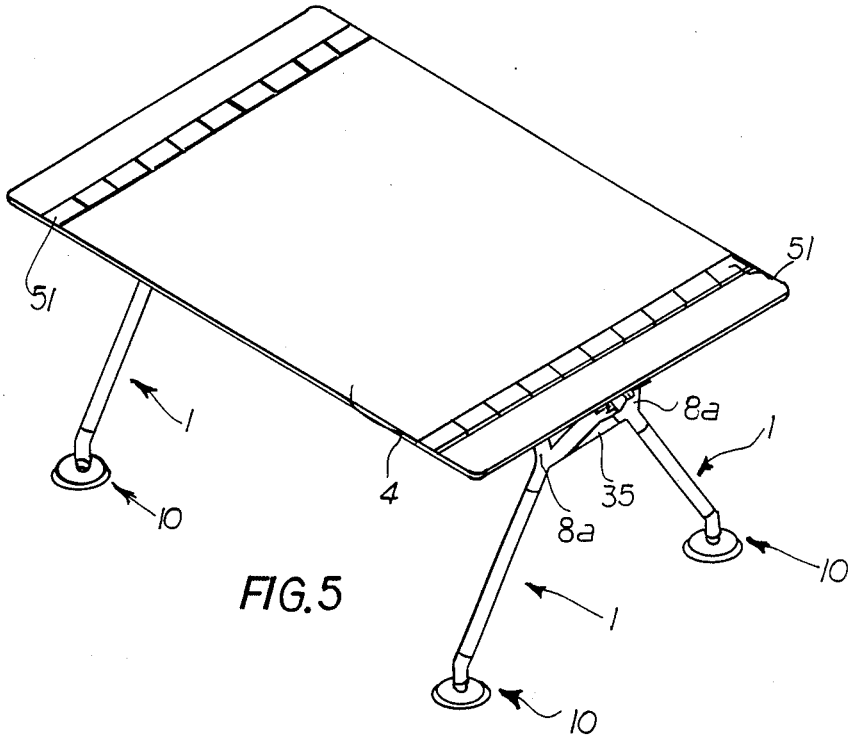
FIG. 5 is a perspective view of a table having a structure according to this invention in an alternative, in perspective view embodiment, in perspective view.
Figure 7:
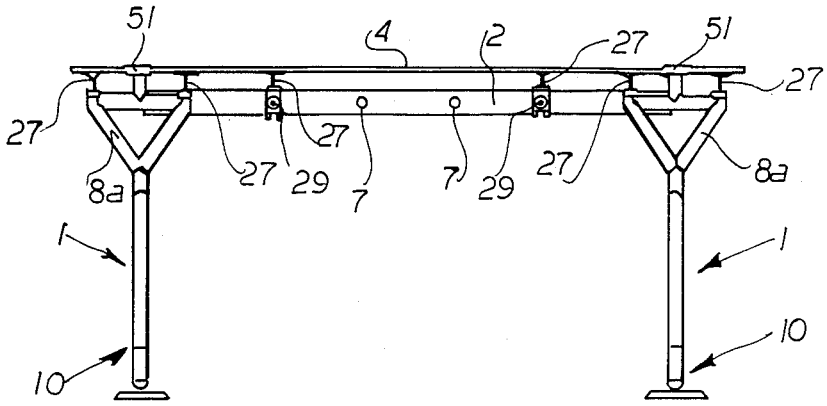
FIG. 7 is a front view of the table of FIG. 5.

As shown in FIG. 5, the present invention in alternative embodiment provides a structure for tables, desks, work tables and the like, which is composed of two pairs of inclined legs 1, connected together by a connecting element composed of a tubular member 2, equipped with several pairs of diametrally opposite threaded connectors 7, by which the legs 1 and the other supporting elements of the structure are connected together.

Figure 6:
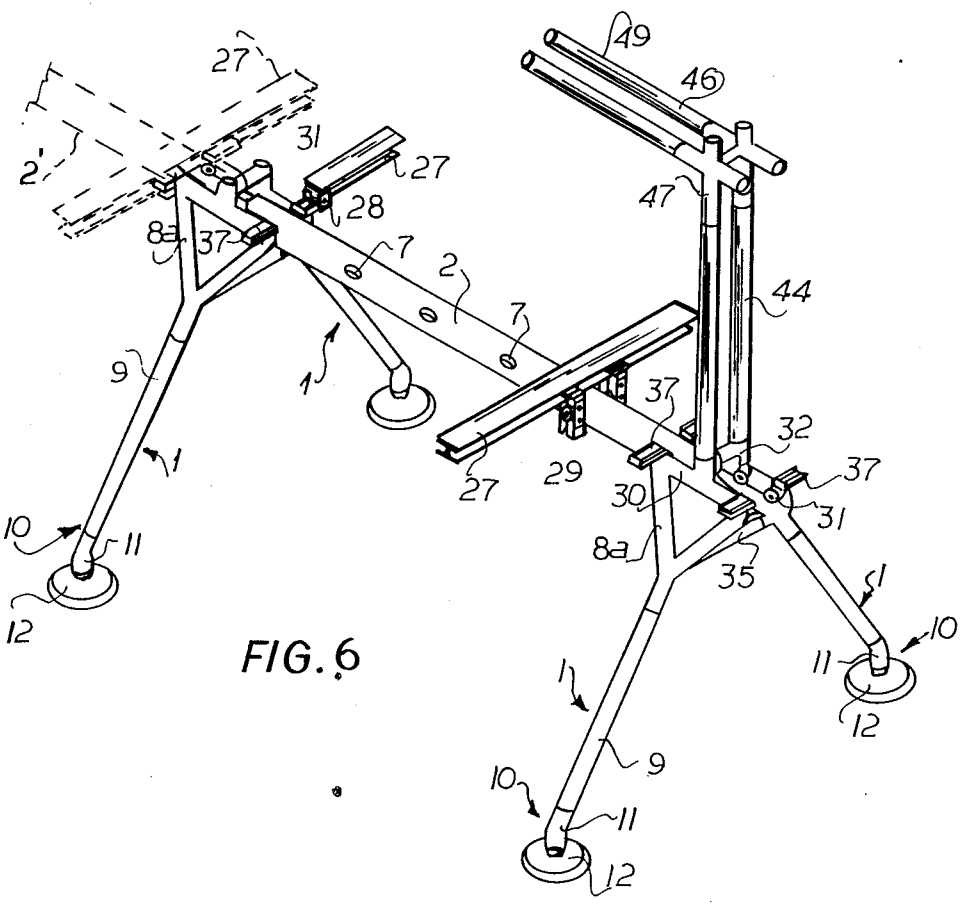
FIG. 6 is a perspective view, partly broken away of the structure of the table according to the alternative form of FIG. 5.

To the legs 1 and to the tubular member 2, there is connected a working plane 4, which is carried by transverse beams 27, which can be seen in FIG. 6, connected to the legs 1 and to the tubular member 2 respectively by junction clamps 28, 29.

In greater detail, as illustrated in FIGS. 8 and 9, each leg possesses an upper part 8*a* having a tubular structure of substantially triangular shape, with its apex downwards, to the apex of which there is connected the rectilinear tubular portion 9 of the leg, which carries at its lower end the floor support foot 10, having the bearing disc 12 or roller or similar device, depending upon the requirements, as described above.

On the side 30 constituting the base of the triangle formed by the upper part 8*a* of the legs, there are present the connectors 31 which straddle the tubular member 2, for example four in number, by means of some of which the part 8*a* is attached to the tubular member 2; the side 30 furthermore possesses a perpendicular stub pipe 32, from which there departs a further cylindrical bifurcation 33, having a horizontal axis.

Near the lower apex 34 of the triangle formed by the upper part 8 of the leg, there is also connected a further horizontal cylindrical transverse member 35; as illustrated in FIG. 8, when a pair of parts 8*a* is secured to the mutually opposed threaded connectors of the tubular body 2, the bifurcations 33 facing each other come into contact above the member 2, while the transverse member 35 joins the parts 8*a* below the member 2 itself, thereby obtaining, as a consequence of the gripping of the screws 36 or similar fixing means, a rigid structure, with the legs 1 disposed obliquely in a vertical plane transverse to the tubular member 2.

The legs 1 may have a symmetrical inclination, for example for tables or desks intended for two-fronted use, or may be of asymmetrical form, for example for tables or desks intended for use from one side only, in which case the two coupled together parts 8*a* of each pair of legs differ from one another.

The parts 8*a* possess, at the ends of the upper side 30, a pair of slides 37; said slides have, on the upper surface, a groove adapted for seating the lower flange of the beam 27, which appropriately may have a double T-section with unequal flanges, the lower flange having the smaller width.

A beam 27 therefore is secured to each of the slides 37 of a pair of parts 8*a* connected together, by means of the clamps 28, composed basically of a pair of C-shaped elements tightened together, by means of screws 38 or the like, and enclosing between them the lower flange of the beam 27, all as shown in FIG. 9.

The beams 27 furthermore may be connected to the tubular member 2 by means of a pair of threaded connectors 7, which are not used for securing the legs 1, by the help of clamps 29, illustrated in detail in FIGS. 10 and 11. These clamps are composed of a pair of facing elements 39, having shaped end parts 40 possessing recessess adapted for receiving the lower flange of the beam 27, and they can be clamped around this flange by means of screws 41 or the like.

In a direction perpendicular to the contact plane between the elements 39 there is also a hole adapted for permitting the fixing of the clamp to one of the connectors 7 by means of a screw 42.

Figure 12:
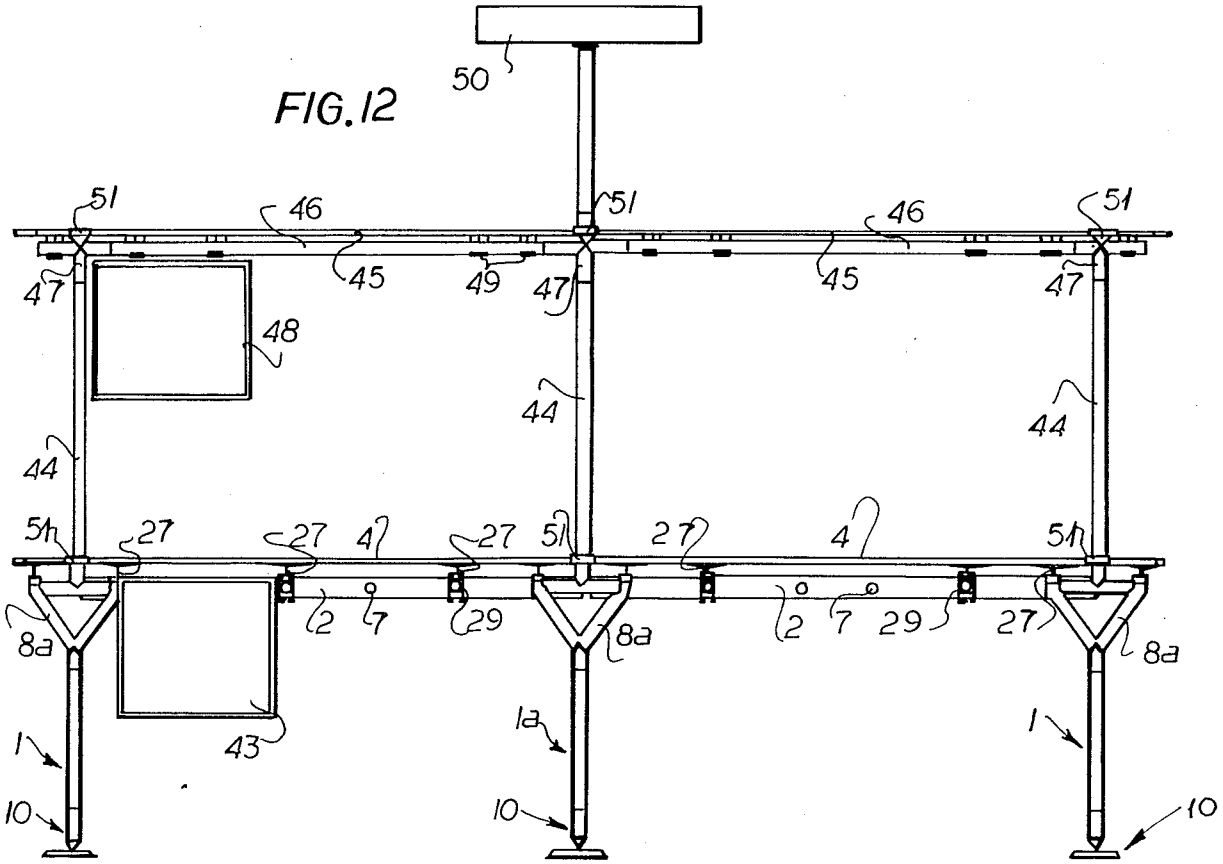
FIG. 12 is a front view of a working table having several positions and with an upper a working table having several positions and with an upper support plane having a structure according to this invention.

The shaped end parts 40 are symmetrically arranged in the upper and lower parts of the clamps 29; the upper parts 40 may be used for fixing the beams 27, as already stated, while the lower parts 40 permit the fixing to the tubular member 2 of suspended objects, such as chests of drawers 43, support planes and the like, positioned beneath the surface of the working plane 4, as shown for example in FIG. 12.

In the case of a single table, shown in FIG. 5, the plane 4 entirely covers the supporting structure; several tables or desks may, however, be connected together in succession, as indicated in FIG. 12; in such a case two tubular members 2, in alignment, are connected to the intermediate legs 1*a*, one of these tubular members being shown in broken lines in FIG. 6 and referenced 2'; for this purpose the connectors 31 of the elements 8*a* are four in number for each element, thus making possible the rigid connection to a pair of them of a tubular member 2, and the connection of a further tubular member 2', contiguous to the first, to the remaining pair of connectors 31.

The stub pipes 32, having a vertical axis, may be connected to rectilinear cylindrical uprights 44; said uprights, as shown in FIG. 12, permit the supporting of an upper bearing plane 45, advantageously of smaller width than the working plane.

This plane 45 is supported by horizontal cylindrical elements 46, secured to the uprights 26 by means of cruciform members 47, connected in turn to each other. To the horizontal elements 46 there may be connected, in the lower part, other members, such as shelves or containers 48, individual lamps, telephone equipment, computers, video units and the like, depending upon the requirements, by the use of connectors 49 disposed on the elements 46 themselves, below and above.

By means of the connectors 49 situated in the upper part of the elements 46, the upper plane 45 is attached. Above the plane 45 further objects, such as for example a lamp 50, may be attached to the cruciform member 47.

The uprights 44 may also be of telescopic type, incorporating lifting jacks or the like, so as to permit the plane 45 to be brought nearer to the working plane 4, to permit easy access to the objects arranged on the plane 45, and then to raise the plane 45 itself, thereby eliminating possible interference by it when in the lowered position.

In the case of several contiguous planes, whether at the working level as the plane 4 or raised as the plane 45, the free space between them, necessary to permit passage of the uprights 44 or of the cruciform members 47, may be closed by make-up filling elements 51, or planes equipped with a shaped edge corresponding to such zones may be provided.

With the supporting structure described, whether in the form of embodiment of FIGS. 1 or 4, or in the form of embodiment of FIG. 5, there may also be associated numerous further working planes, having specific characteristics in relation to the intended use, such as planes that may be raised and orientated by articulated supports, illuminated planes, shaped planes and so on.

Numerous variants may be introduced into the realization of this invention, whether in respect of specific forms of particular constructions, or in respect of the aesthetic characteristics, without thereby departing from the scope of the invention in its general characteristics.

What is claimed is:

1. An article of furniture comprising:

a modular support including:

an elongated horizontal cylindrical one-piece tubular element extending longitudinally and formed at longitudinally spaced locations with pairs of diametrically and horizontally oppositely open lateral threaded connectors having horizontal axes, at least one surface-carrying member provided with at least one pair of connecting formations straddling the cylindrical element in alignment with a corresponding pair of the threaded connectors, two longitudinally spaced pairs of legs connected to the cylindrical element at the ends thereof with the legs of each pair lying in a common generally vertical plane, each pair of legs being provided with a respective connecting formation upwardly straddling the cylindrical element and aligned with a respective pair of the threaded connectors, respective horizontal ties interconnecting the legs of each pair below the cylindrical element, screws traversing the formations along the horizontal axes and threaded into the threaded connectors aligned therewith for securing the surface-carrying member and the legs to the cylindrical element, respective pairs of upright connection stubs projecting upwardly from the connecting formations of the legs to each side of the cylindrical element;

means forming a lower working plane for the article of furniture mounted on the surface-carrying member;

respective uprights fixed to and projecting upward from the connection stubs past the lower working plane;

respective horizontal elements connected between the uprights above the lower working plane; and means forming an upper working plane for the article of furniture mounted on the horizontal elements above the lower working plane.

2. The article of furniture defined in claim 1 wherein each surface-carrying member includes a pair of clips secured by respective such screws to the respective connectors and a respective horizontal beam held by the respective clips and carrying the respective working plane.

3. The article of furniture defined in claim 2 wherein each clip includes a pair of clip elements held by a respective such screw to a respective such connector and a bolt traversing the clip elements and clamping same oppositely to the respective beam.

4. The article of furniture defined in claim 1, further comprising a crosspiece interconnecting each upright to the respective horizontal element.

5. The article of furniture defined in claim 1, further comprising storage units secured underneath the upper working plane.

* * * * *